United States Patent [19]

Jones et al.

[11] Patent Number: 5,002,505

[45] Date of Patent: Mar. 26, 1991

[54] SHOCK SAFE FUSE PULLER WITH BLOWN FUSE INDICATOR AND IMPROVED FUSE RETAINER

[75] Inventors: William H. Jones, Villa Park; Clayton D. Heidorn, Glen Ellyn, both of Ill.

[73] Assignee: Reed Devices, Inc., Carol Stream, Ill.

[21] Appl. No.: 442,054

[22] Filed: Nov. 28, 1989

[51] Int. Cl.[5] ..... H01R 13/68

[52] U.S. Cl. ..... 439/622; 439/490; 337/263; 337/213

[58] Field of Search ..... 439/620, 621, 890, 490; 337/257, 260, 261, 263–266, 208, 209, 213, 214, 215

[56] References Cited

U.S. PATENT DOCUMENTS

| | | | |
|---|---|---|---|
| 2,783,331 | 2/1957 | Sundt | 337/215 |
| 3,056,870 | 10/1962 | Andres | 337/215 |
| 3,202,788 | 8/1965 | George | 337/215 |
| 3,225,163 | 12/1965 | Linton | 337/214 |
| 3,229,065 | 1/1966 | Borys | 337/263 |
| 3,813,626 | 5/1974 | Cetola et al. | 337/245 |
| 4,094,212 | 6/1978 | Hyams et al. | 81/3.8 |
| 4,126,368 | 11/1978 | Godfrey et al. | 339/91 R |
| 4,128,024 | 12/1978 | Hyams et al. | 81/3.8 |
| 4,268,106 | 5/1981 | Moerre | 439/621 |
| 4,488,767 | 12/1984 | Lehman et al. | 337/215 |

FOREIGN PATENT DOCUMENTS

| | | | |
|---|---|---|---|
| 702234 | 1/1954 | United Kingdom | 439/621 |

*Primary Examiner*—David L. Pirlot

*Attorney, Agent, or Firm*—Weingarten, Schurgin, Gagnebin & Hayes

[57] ABSTRACT

A shock-safe fuse holder for a cartridge fuse is provided which can be readily installed in a mating receptacle and removed therefrom for fuse replacement. The fuse holder includes a visual indicator for denoting a blown or missing fuse. The cartridge fuse is substantially enclosed within the holder to limit the access to the electrical contacts of the cartridge fuse to minimize the danger of electrical shock. The holder has a configuration for retaining the holder in a mating fuse receptacle even in the absence of an installed fuse.

9 Claims, 2 Drawing Sheets

SHOCK SAFE FUSE PULLER WITH BLOWN FUSE INDICATOR AND IMPROVED FUSE RETAINER

FIELD OF THE INVENTION

This invention relates to electrical fuse holders and more particularly to a shock-safe fuse holder for a cartridge type fuse.

BACKGROUND OF THE INVENTION

Cartridge fuse holders are known in which a cartridge fuse is retained within a housing configured to permit the cartridge to be plugged into mating contact with a fuse receptacle and to be removed therefrom. Fuse holders of known construction are shown for example in U.S. Pat. Nos. 4,128,024, 4,094,212, 3,813,626 and 4,126,368.

In fuse holders of conventional construction the holder can in many instances not be retained in a fuse receptacle without a cartridge fuse being present in the holder. In addition, conventional fuse holders often do not include any means for verifying that a fuse is disposed in the holder or that the fuse is good without removal of the holder from the receptacle and inspection and/or testing of the fuse.

SUMMARY OF THE INVENTION

In brief, the present invention provides a shock-safe fuse holder for a cartridge fuse which can be readily installed in a mating receptacle and removed therefrom for fuse replacement. The fuse holder includes a visual indicator for denoting a blown or missing fuse. The cartridge fuse is substantially enclosed within the holder to limit the access to the electrical contacts of the cartridge fuse to minimize the danger of electrical shock.

The fuse holder in accordance with the invention comprises an integral body of electrically insulative material having first and second end sections each including an end wall and an electrical contact for engagement by the conductive cap of the fuse. Each end section also includes a finger extending transversely to the end wall and having a tapered or ramp surface operative to bias the cartridge fuse into a seated position against a rear abutment which is part of the housing. The housing includes an internal cavity in which is disposed a light emitting diode or other light emitter connected to the fuse holder contacts and operative to illuminate in the presence of a blown or missing fuse. The housing includes a window area for visual access to the emitted light.

The finger portions of the fuse holder body are configured to mate with the fuse clips of a fuse receptacle in the absence of a fuse within the holder, for the purpose of retaining the holder in the receptacle even in the absence of a fuse. Such retention of an empty fuse holder in its receptacle minimizes the opportunity to lose or misplace the holder. The placement of the holder in the receptacle also minimizes the opportunities for shock by covering the exposed fuse clips of the receptacle, or for damage of the electrical contacts.

DESCRIPTION OF THE DRAWINGS

The invention will be more fully understood from the following detailed description taken in conjunction with the accompanying drawings in which.

DETAILED DESCRIPTION OF THE INVENTION

Figure 1:
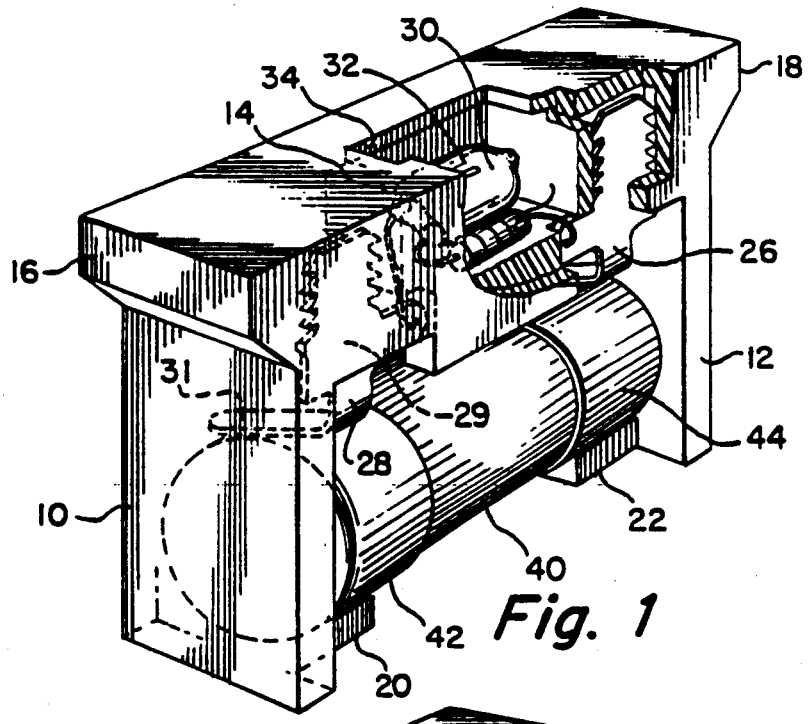
FIG. 1 is a pictorial view of a fuse holder in accordance with the invention.
Figure 1A:
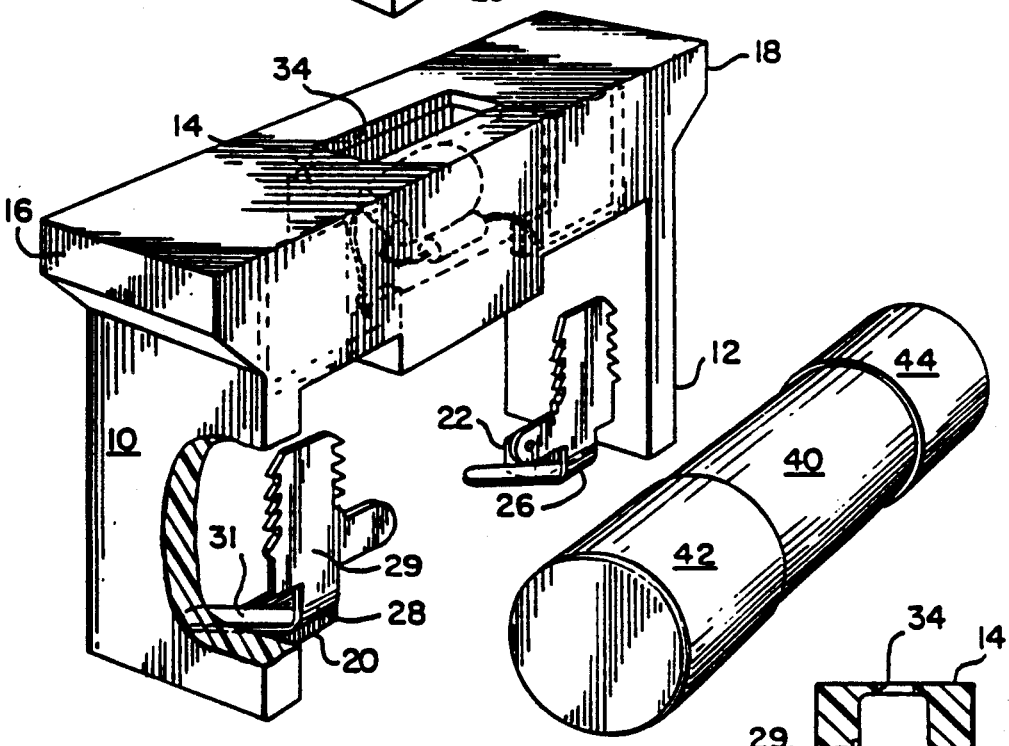
FIG. 1A is an exploded view of the fuse holder of FIG. 1.

Referring to the drawing there is shown a shock-safe cartridge fuse holder comprising two end walls 10 and 12 which are generally parallel to each other and perpendicular to a central body portion 14. Emerging from the central body are two oppositely extending handle portions 16 and 18 which are typically grasped by the thumb and forefinger of a user to be either pushed in or pulled out of a mating fuse receptacle. Fingers 20 and 22 extend transversely to respective end walls 10 and 12. The inner surface of each of the fingers includes a tapered surface 23 which tapers downward away from the fuse-loading side of the body, and an upstanding lip 25. An abutment or backstop 24 downwardly extends from the central body portion 14. Electrical contacts 26 and 28 are retained in associated openings in the body portion 14 by a barbed retaining end 29 interference fitted into the associated opening. Each of the contacts includes a contact end 31 disposed below the central body portion and adjacent to the respective end wall.

A cartridge fuse 40 having cylindrical conductive end caps 42 and 44 is retained within the fuse holder between the end walls 10 and 12 and with the conductive end caps in electrical engagement with respective contacts 31. The rearwardly directed tapers on the fingers 20 and 22 bias the fuse into the holder and into engagement with the abutment 24. The lip 25 of the fingers serves to retain the cartridge fuse in position within the holder. The fingers are sufficiently resilient to yield in response to insertion of a fuse and to return to a rest position once the fuse is fully seated.

The central body portion 14 preferably includes a cavity 30 in which is disposed a light emitting diode or other light emitting element 32 which is connected by leadwires 34 to respective contacts 26 and 28. A current limiting resistor 33 or other associated components may also be connected in circuit with the light emitting diode. With the holder plugged into a live fuse receptacle, the light emitting diode is operative to illuminate in the absence of a fuse installed in the holder or in the presence of a blown fuse. Illumination of the light emitting diode is visible through a light transmissive window area 34 which may be an opening in the front surface of the holder or a light transmissive window.

The fingers 20 and 22 at respective ends of body 14 are cooperative with the respective fuse clips 50 in the absence of a fuse installed in the holder, such that with the fuse holder seated in the fuse receptacle, the fingers 20 and 22 are urged inwardly beyond the minimum gap width of fuse clips 50 to loosely retain the fuse holder in the fuse clips in the absence of an installed fuse. The retention of the fuse holder in the fuse receptacle even in the absence of an installed fuse prevents the holder from remaining separate and thereby subject to being lost or mislayed, and also shields the fuse clips from damage and from being inadvertently touched by an individual with consequent danger of shock or electrocution. The engagement of the contacts 31 with the fuse clips directly in the event of a missing fuse also permits a voltage to be present between the contacts 31 to cause illumination of the lamp or light emitting diode 32 thereby to denote a missing fuse.

Figure 7:
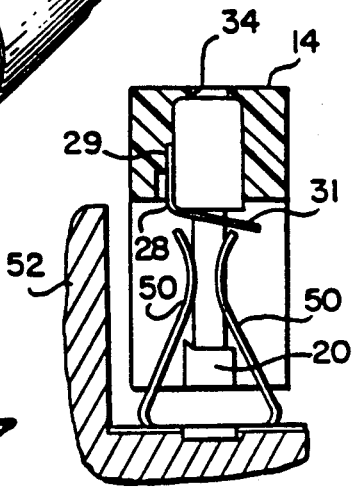
FIG. 7 is a sectional end view of the fuse holder plugged into a mating fuse clip of a fuse receptacle.
Figure 5:
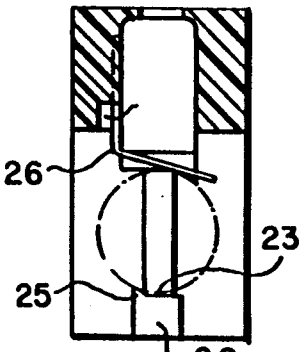
FIG. 5 is a sectional end view taken along lines 5—5 of FIG. 2.
Figure 6:
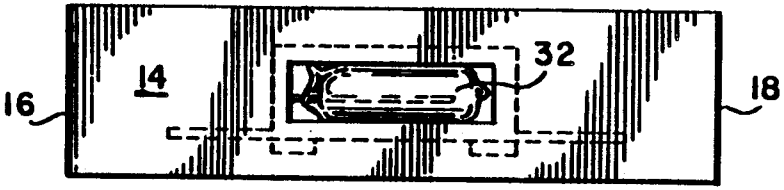
FIG. 6 is a top view of the fuse holder of FIG. 2.
Figure 2:
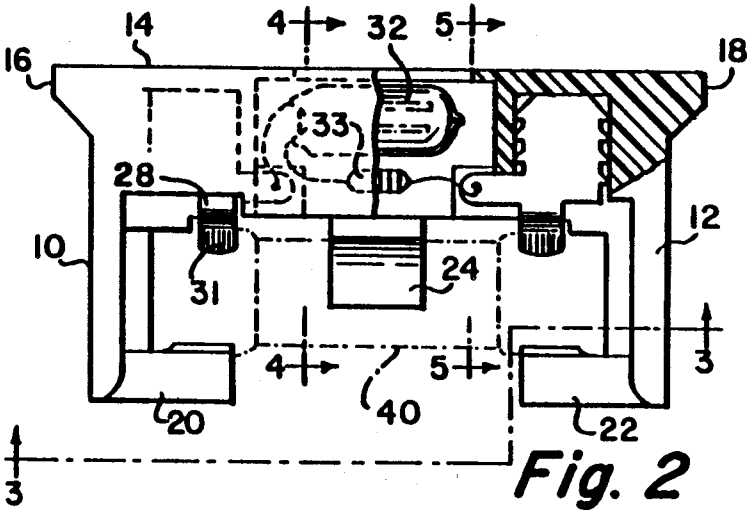
FIG. 2 is a partly sectioned elevation view of the fuse holder of FIG. 1.
Figure 3:
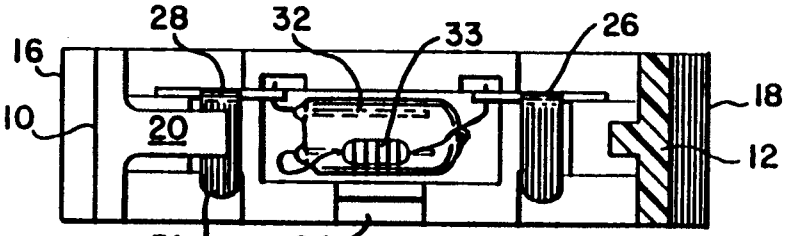
FIG. 3 is a view taken along lines 3—3 of FIG. 2.
Figure 4:
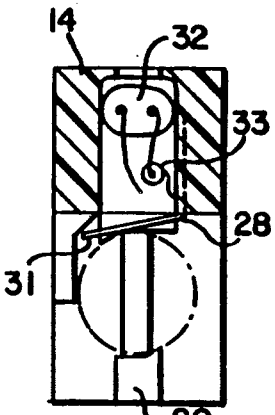
FIG. 4 is an end view taken along lines 4—4 of FIG. 2.

When the fuse holder is grasped by the handles 16 and 18 by the fingers of a user, access to the installed cartridge fuse is very limited, resulting in minimization of the opportunity for electrical shock by inadvertent engagement with the conductive end caps of the cartridge fuse or the conductive contacts of the fuse holder. The fuse holder with the cartridge fuse disposed therein can be readily plugged into the fuse clips 50 of a mating receptacle 52, as shown in FIG. 7. The fuse holder can also be readily unplugged from the mating receptacle to permit replacement of a blown fuse.

The invention is not to be limited by what has been particularly shown and described except as indicated in the appended claims.

What is claimed is:

1. A shock safe fuse holder for a cartridge fuse having a cylindrical body and cylindrical conductive end caps, the holder comprising:

an integral body of electrically insulative material having first and second end sections each including:

an end wall, and an electrical contact disposed transversely to the end wall;

the end sections being spaced to define a cavity for accommodation of a cartridge fuse therein with the fuse caps in electrical engagement with the respective contacts of the end sections;

an insulating finger extending transversely from the end wall and having means operative to urge an inserted fuse into engagement with the electrical contact; and handle means on the body operative for manual insertion of the body into a mating fuse receptacle and for removal of the body therefrom.

2. The fuse holder of claim 1 including:

a chamber in the body between the end sections and having at least one light transmissive window in a wall of the body; and a light emitter disposed in the chamber and electrically connected to the contacts of the end sections, light from the emitter being visible via the light transmissive window when a fuse in the holder is blown or missing and a voltage is present across the contacts.

3. The fuse holder of claim 1 wherein the integral body includes an abutment downwardly extending from a central portion of the body and operative to serve as a stop for an inserted cartridge fuse.

4. The fuse holder of claim 1 wherein each of the fingers is configured to be retained in a fuse clip of a mating receptacle in the absence of an installed fuse.

5. The fuse holder of claim 1 wherein each of the electrical contacts includes a retaining end secured in an opening in the body, and a contact end adjacent to the end wall and positioned to engage an end cap of a cartridge fuse installed in the body.

6. The fuse holder of claim 1 wherein each of the fingers includes a tapered surface for urging a cartridge fuse into seated position in the body.

7. The fuse holder of claim 6 wherein each of the fingers includes a raised lip for retaining a fuse seated in the body.

8. The fuse holder of claim 1 wherein the integral body has a central body portion containing said chamber, and wherein the central body portion has an outer face containing the light transmissive window.

9. The fuse holder of claim 8 wherein the handle means comprises outward extensions of the central body portion and configured to be grasped by the thumb and forefinger of a user.

* * * * *